US010770012B2

(12) United States Patent
Lin

(10) Patent No.: US 10,770,012 B2
(45) Date of Patent: Sep. 8, 2020

(54) DISPLAY PANEL AND DISPLAY DEVICE

(71) Applicant: HKC Corporation Limited, Shenzhen, Guangdong (CN)

(72) Inventor: Peixin Lin, Guangdong (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

(21) Appl. No.: 16/446,667

(22) Filed: Jun. 20, 2019

(65) Prior Publication Data

US 2020/0202803 A1 Jun. 25, 2020

Related U.S. Application Data

(63) Continuation of application No. PCT/CN2019/071869, filed on Jan. 16, 2019.

(30) Foreign Application Priority Data

Dec. 24, 2018 (CN) ..... 2018 1 1585892

(51) Int. Cl.
*G09G 3/36* (2006.01)

(52) U.S. Cl.
CPC ..... *G09G 3/3648* (2013.01); *G09G 3/3674* (2013.01); *G09G 2300/0439* (2013.01); *G09G 2320/0626* (2013.01); *G09G 2330/045* (2013.01)

(58) Field of Classification Search
CPC .... G09G 3/614; G09G 3/3688; G09G 3/3685; G09G 3/3648; G09G 3/3674; G09G 2300/0439; G09G 2320/0626; G09G 3/2074; G09G 3/3607; G09G 2300/0443
See application file for complete search history.

(56) References Cited

U.S. PATENT DOCUMENTS

2015/0221273 A1* 8/2015 Lee ..... G09G 3/3677 345/698

* cited by examiner

*Primary Examiner* — Dennis P Joseph

(57) ABSTRACT

The present disclosure discloses a display panel, including a plurality of display units extending along a first direction and arranged along a second direction, the display unit includes a first subpixel column, a second subpixel column, a first data line and a second data line, all of which are arranged along the second direction. The first subpixel column includes first subpixels arranged along the first direction, the second subpixel column includes second subpixels arranged along the first direction. The first data lines are electrically connected with the first subpixels and the second subpixels of a first driving polarity in the first subpixel column and the second subpixel column, the second data lines are electrically connected with the first subpixel and the second subpixel of a second driving polarity in the first subpixel column and the second subpixel column.

20 Claims, 15 Drawing Sheets

| | | | | | | | |
|---|---|---|---|---|---|---|---|
| + | - | + | - | + | - | + | ... |
| - | + | - | + | - | + | - | ... |
| - | + | - | + | - | + | - | ... |
| + | - | + | - | + | - | + | ... |
| + | - | + | - | + | - | + | ... |
| - | + | - | + | - | + | - | ... |
| - | + | - | + | - | + | - | ... |
| ... | ... | ... | ... | ... | ... | ... | ... |

FIG. 2A

| | | | | | | | |
|---|---|---|---|---|---|---|---|
| - | + | - | + | - | + | - | ... |
| + | - | + | - | + | - | + | ... |
| + | - | + | - | + | - | + | ... |
| - | + | - | + | - | + | - | ... |
| - | + | - | + | - | + | - | ... |
| + | - | + | - | + | - | + | ... |
| + | - | + | - | + | - | + | ... |
| ... | ... | ... | ... | ... | ... | ... | ... |

FIG. 2B

| | | | | | | | |
|---|---|---|---|---|---|---|---|
| + | - | - | + | + | - | - | ... |
| - | + | + | - | - | + | + | ... |
| - | + | + | - | - | + | + | ... |
| + | - | - | + | + | - | - | ... |
| + | - | - | + | + | - | - | ... |
| - | + | + | - | - | + | + | ... |
| - | + | + | - | - | + | + | ... |
| ... | ... | ... | ... | ... | ... | ... | ... |

FIG. 3A

| | | | | | | | |
|---|---|---|---|---|---|---|---|
| - | + | + | - | - | + | + | ... |
| + | - | - | + | + | - | - | ... |
| + | - | - | + | + | - | - | ... |
| - | + | + | - | - | + | + | ... |
| - | + | + | - | - | + | + | ... |
| + | - | - | + | + | - | - | ... |
| + | - | - | + | + | - | - | ... |
| ... | ... | ... | ... | ... | ... | ... | ... |

FIG. 3B

DISPLAY PANEL AND DISPLAY DEVICE

CROSS REFERENCE TO RELATED APPLICATIONS

The present application is a Continuation Application of PCT Application No. PCT/2019/071869 filed on Jan. 16, 2019, which claims the benefit of Chinese Patent Application No. 201811585892.0, filed on Dec. 24, 2018, which is incorporated herein by reference in its entirety.

FIELD

The present disclosure relates to the field of display technology, and in particular, relates to a display panel and a display device.

BACKGROUND

In a display panel, the brightness of each subpixel changes according to the change of drive signal in the data line, thereby allowing the display panel to display a certain image. In order to display a correct image and avoid the phenomena of display panel polarization and common voltage shift, a driving signal in the data line is a high-frequency signal whose polarity changes rapidly with time. However, a high-frequency driving signal is prone to result in a significant increase of power consumption of the circuit (including chip and circuit), thus increasing the driving power consumption required for the display panel, and it is prone to cause potential danger due to overheating of the circuit.

SUMMARY

The main purpose of the present disclosure is to provide a display panel, aiming at solving the technical problem that the frequency of a driving signal in the data line is too high, to reduce the driving power consumption of the display panel and avoid potential danger caused by overheating of the circuit.

In order to achieve the above objects, the present disclosure provides a display panel which includes a plurality of display units, the display units extend along a first direction and are arranged along a second direction; the display unit includes a first subpixel column, a second subpixel column, a first data line and a second data line, all of which are arranged along a second direction, and the first subpixel column includes first subpixels arranged along the first direction, and one first subpixel is electrically connected with only one first data line or one second data line; the second subpixel column includes second subpixels arranged along a first direction, and one second subpixel is only electrically connected with one first data line or one second data line; the first data line is electrically connected with the first subpixel and the second subpixel of a first driving polarity in the first subpixel column and the second subpixel column; the second data line is electrically connected with the first subpixel and the second subpixel of a second driving polarity in the first subpixel column and the second subpixel column.

In order to achieve the above object, the present disclosure also provides a display panel including a plurality of display units and a plurality of scanning lines, the display units extends along a first direction and are arranged along a second direction; the display unit includes a first subpixel column, a first data line, a second data line and a second subpixel column which are sequentially arranged along a second direction, and the first subpixel column includes first subpixels arranged along the first direction, and two first subpixels adjacent to any first subpixel in the first subpixel column are respectively electrically connected with the first data line and the second data line; the second subpixel column includes second subpixels arranged along the first direction, the second subpixels and the first subpixels are arranged in a rectangular array, and two second subpixels adjacent to any second subpixel in the second subpixel column are respectively electrically connected with the first data line and the second data line; the first subpixel and the second subpixel located on a same row are electrically connected with the first data line and the second data line; the scanning lines extend along the second direction, and the scanning lines are arranged along the first direction, the first subpixel and the second subpixel on a same row form a subpixel row, the subpixel row and the scanning line are arranged alternately along the first direction, and the first subpixel and the second subpixel on a same row are electrically connected with the same scanning line, one first subpixel is electrically connected with only one scanning line, and one second subpixel is electrically connected with only one scanning line.

In order to achieve the above object, the present disclosure further proposes a display device, which includes a display panel and a driving unit, and the display panel includes a plurality of display units, and the display units extend along a first direction and are arranged along a second direction; the display unit includes a first subpixel column, a second subpixel column, a first data line and a second data line, all of which are arranged along the second direction, and the first subpixel column includes first subpixels arranged along the first direction, and one first subpixel is electrically connected with only one of the first data line or the second data line; the second subpixel column includes second subpixels arranged along the first direction, and one second subpixel is only electrically connected with one first data line or one second data line; the first data line is electrically connected with the first subpixel and the second subpixel of a first driving polarity in the first subpixel column and the second subpixel column; the second data line is electrically connected with the first subpixel and the second subpixel of a second driving polarity in the first subpixel column and the second subpixel column, the driving unit is electrically connected with the data line, and the driving unit is arranged to output a driving signal to the data line.

In the technical scheme of the present disclosure, the display panel includes a plurality of display units, and the display units extend along a first direction and are arranged along a second direction; The display unit includes a first subpixel column, a second subpixel column, a first data line and a second data line, all of which are arranged along a second direction, and the first subpixel column includes first subpixels arranged along the first direction, and one first subpixel is only electrically connected with one first data line or one second data line; the second subpixel column includes second subpixels arranged along the first direction, and one second subpixel is electrically connected only to one first data line or one second data line; The first data line is electrically connected with the first subpixel and the second subpixel of the first driving polarity in the first subpixel column and the second subpixel column; the second data line is electrically connected with the first subpixel and the second subpixel of the second driving polarity in the first subpixel column and the second subpixel column.

During the operation of the display panel, the driving signal in the data line charges the first subpixel and the second subpixel to control the brightness of the first subpixel and the second subpixel. When all the first subpixels and second subpixels of the first driving polarity in a display unit are electrically connected with the first data line, and all first subpixels and second subpixels of the second driving polarity are electrically connected with the second data line, driving signals with the first driving polarity and the second driving polarity are respectively output from the first data line and the second data line, and the first driving polarity and the second driving polarity are unchanged at least for a period of time corresponding to one frame of the display screen. Therefore, the polarity of the driving signal in the data line may be kept unchanged. Compared with the case where the first subpixel and the second subpixel with different driving polarities are connected with the same data line, the frequency of the required driving signal is greatly reduced, thereby effectively reducing the driving power consumption of the display panel, reducing the heat generated by the high-frequency driving signal and avoiding the potential danger caused by overheating of the circuit.

BRIEF DESCRIPTION OF THE DRAWINGS

FIG. 2A is a schematic diagram of a driving mode of a display panel, which shows the driving polarity applied to the subpixel 111' by the driving signal Dn' in one frame display panel;

FIG. 2B is a schematic diagram of a driving mode of a display panel, which shows the driving polarity applied to the subpixel 111' by the driving signal Dn' in one frame display panel adjacent to the frame display panel of FIG. 2A;

FIG. 3A is a schematic diagram of another driving mode of a display panel in some embodiments of the present disclosure, which shows the driving polarity of the driving signal Dn' applied to the subpixel 111' in one frame display panel;

FIG. 3B is a schematic diagram of another driving mode of a display panel in some embodiments of the present disclosure, which shows the driving polarity of the driving signal Dn' applied to the subpixel 111' in one frame display panel adjacent to the frame display panel of FIG. 3A;

Figure 1:
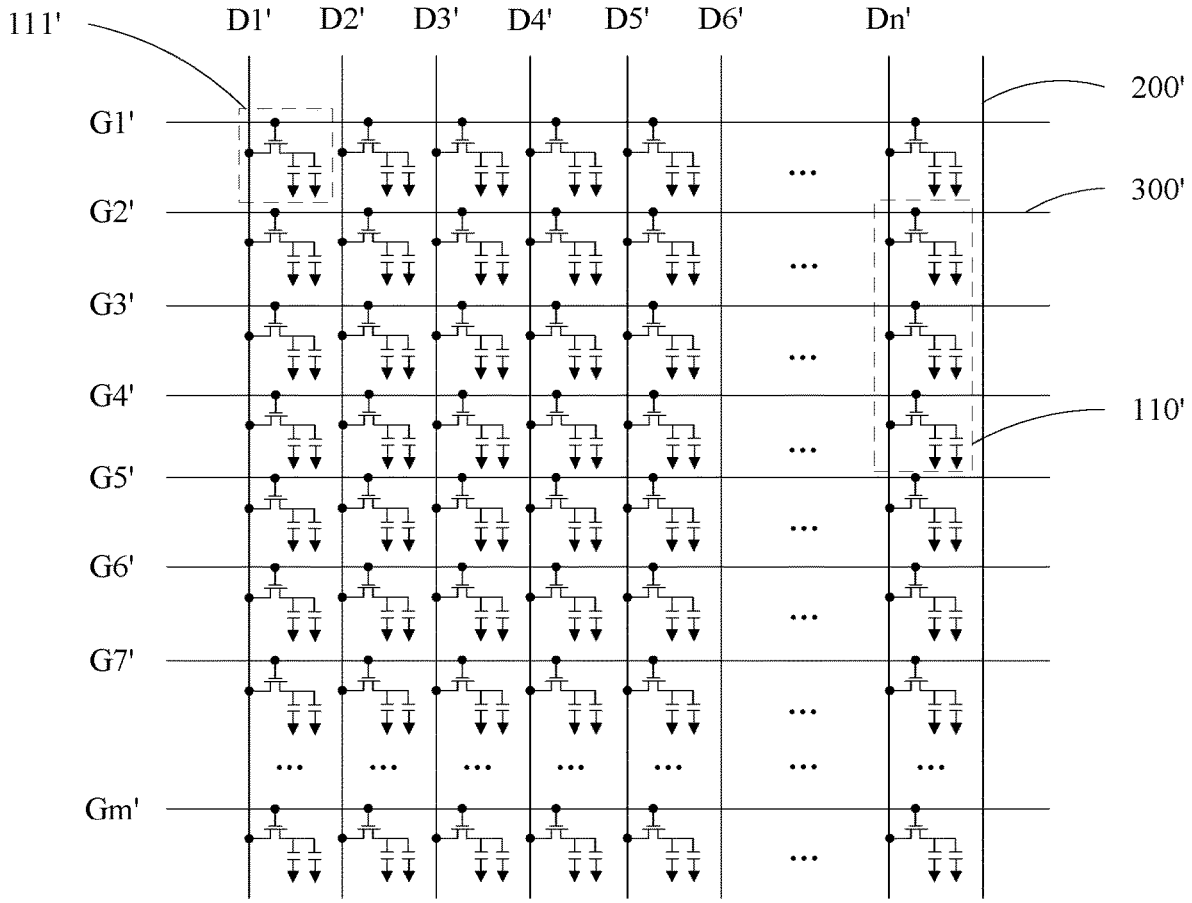
FIG. 1 is a structural diagram of a display panel in prior art.

The realization, functional features and advantages of the purpose of the present disclosure will be further described with reference to the accompanying drawings in conjunction with the embodiments.

DETAILED DESCRIPTION OF THE EMBODIMENTS

The technical scheme in the embodiment of the present disclosure will be described clearly and completely in the following with reference to the drawings in the embodiment of the present disclosure. Obviously, the described embodiment is only a part of the embodiment of the present disclosure, but not all of the embodiments. Based on the embodiments in the present disclosure, all other embodiments obtained by a person of ordinary skill in the art without creative labor are within the scope of protection of the present disclosure.

It should be noted that if directional indications (such as up, down, left, right, front, back, etc.) are involved in the embodiments of the present disclosure, the directional indications are only used to explain the relative positional relationship and movement between the components in a certain posture (as shown in the drawings), and if the specific posture changes, the directional indications will change accordingly.

In addition, if there are descriptions of "first" and "second" in the embodiments of the present disclosure, the descriptions of "first" and "second" are for descriptive purposes only and cannot be understood as indicating or implying their relative importance or implicitly indicating the number of indicated technical features. Thus, features defining "first" and "second" may explicitly or implicitly include at least one such feature. In addition, the meaning of "and/or" appearing in the full text is to include three parallel schemes, taking "a and/or b" as an example, including scheme a or b, or schemes that both a and b satisfy at the same time. In addition, the technical solutions between the various embodiments may be combined with each other, but must be based on what one of ordinary skill in the art may achieve. When the combination of technical solutions is contradictory or impossible to achieve, it should be considered that the combination of such technical solutions does not exist and is not within the scope of protection required by the present disclosure.

FIG. 1 is a structural diagram of a display panel in prior art, the display panel includes a plurality of pixels 110', a plurality of data lines 200' and a plurality of scan lines 300'. And a pixel 110' includes subpixel 111'. In general, one pixel 110' includes three subpixels 111', namely, red subpixel, green subpixel and blue subpixel, thereby realizing the display of colorful images by the principle of spatial color mixing. Subpixels 111' are arranged in a rectangular array, data lines 200' and subpixel columns are arranged alternately, and subpixels on a same column are electrically connected with the same data line 200', scanning lines 300' and subpixel rows are arranged alternately, and subpixels on a same row are electrically connected with the same scanning line 300'. Under the action of a scanning signal GM' in the scanning line 300', each row of subpixels 111' are turned on, and when the subpixels 111' are turned on, the subpixels 111' are charged under the driving action of the driving signal Dn' in the data line 200', thereby displaying a certain brightness. As shown in FIGS. 2A and 2B, there is a specific display panel driving method, and FIG. 2A and FIG. 2B show the driving polarity applied to the subpixel 111' by the driving signal Dn' in two adjacent frame display panels, respectively, and the display panels are driven by dot inversion or the like. Then, the polarity of the drive signal Dn' in the data line 200' may change according to the rule of +−++− . . . or −+++−++++ . . . within a frame of time, the drive signal in the data line may undergo multiple polarity inversions, and the frequency of the drive signal Dn' is very high. As shown in FIGS. 3A and 3B, another specific driving mode of the display panel is shown, FIGS. 3A and 3B respectively show the driving polarity of the driving signal Dn' applied to the subpixel 111' in two adjacent frame display panels, and the display panels are driven by dot inversion or the like. Similarly, the polarity of the drive signal Dn' in the data line 200' may change according to the rule of +−++− . . . or −+++−+++ . . . within a frame of time, the drive signal in the data line may undergo multiple polarity inversions, and the frequency of the drive signal Dn' is very high.

Figure 4:
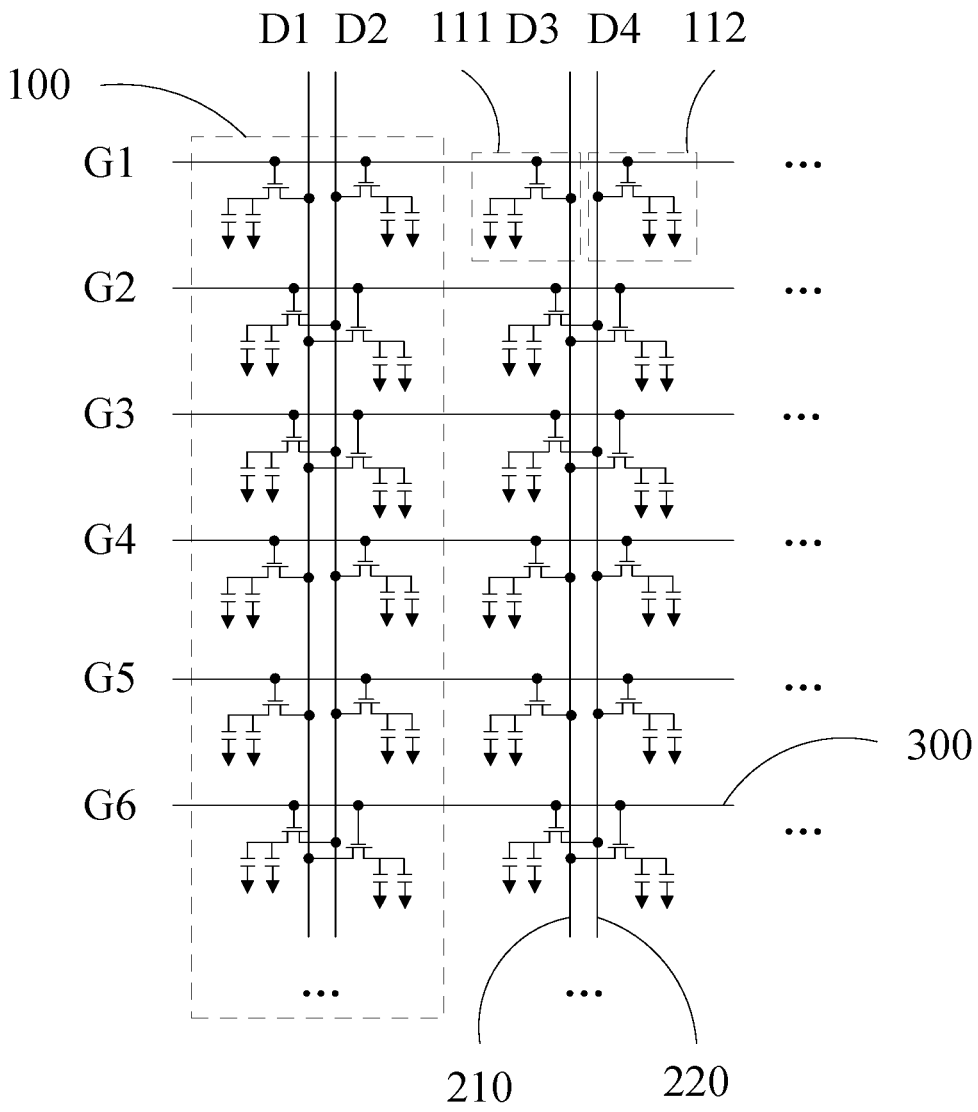
FIG. 4 is a schematic structural diagram of a display panel in some embodiments of the present disclosure.

The present disclosure proposes a display panel. In some embodiments of the present disclosure, as shown in FIG. 4, the display panel includes a plurality of display units 100 extending along a first direction and arranged along a second direction.

The display unit 100 includes a first subpixel column, a second subpixel column, a first data line 210 and a second data line 220, all of which are arranged along a second direction, and:

The first subpixel column includes first subpixels 111 arranged along a first direction, and one first subpixel 111 is electrically connected only to one first data line 210 or one second data line 220;

The second subpixel column includes the second subpixels 112 arranged along the first direction, and one second subpixel 121 is electrically connected only to one first data line 210 or one second data line 220;

The first data line 210 is electrically connected with the first subpixel 111 and the second subpixel 112 of a first driving polarity in the first subpixel column and the second subpixel column;

The second data line 220 is electrically connected with the first subpixel 111 and the second subpixel 112 of the second driving polarity in the first subpixel column and the second subpixel column.

In the following, the technical schemes of the present disclosure may be described in detail by taking the liquid crystal display panel as an example. The first subpixel 111 or the second subpixel 112 includes a subpixel electrode and a switching device, the switching device includes a source electrode, a drain electrode and a gate electrode, the source electrode is electrically connected with a data line corresponding to the first subpixel 111 or the second subpixel 112, and the drain electrode is electrically connected with the subpixel electrode. And the subpixel electrode is made of a transparent conductive material such as indium tin oxide (ITO). The data line charges the subpixel electrodes through the switching device, and then controls the liquid crystal deflection to display a certain brightness. Of course, the display panel may also include a common line and a plurality of storage capacitors, the storage capacitors are respectively arranged corresponding to the subpixels to maintain the deflection direction of the liquid crystal to the next frame of image.

As shown in FIG. 4, the display unit 100 extends along a first direction and is arranged along a second direction, the first direction is the longitudinal direction of the display panel shown in the figure and the second direction is the transverse direction of the display panel shown in the figure. The display unit 100 includes a first subpixel column, a second subpixel column, a first data line 210 and a second data line 220. Among them, the first subpixel column, the second subpixel column, the first data line 210 and the second data line 220 have various arrangements. In order to reduce the polarity inversion frequency of the drive signals in the first data line 210 and the second data line 220, that is, to reduce the frequency of the drive signals, it is only required that the first data line 210 electrically connects with the first subpixel 111 and the second subpixel 112 of the first subpixel column and the second subpixel column. The second data line 220 may be electrically connected with the first subpixel 111 and the second subpixel 112 of the second driving polarity in the first subpixel column and the second subpixel column. The first subpixel 111 and the second subpixel 112 of the first driving polarity refer to the first subpixel 111 and the second subpixel 112 of the same driving polarity at the same time. Similarly, the first subpixel 111 and the second subpixel 112 of the second driving polarity refer to the first subpixel 111 and the second subpixel 112 of the same driving polarity at the same time, and the first driving polarity and the second driving polarity are opposite. When the first subpixel 111 and the second subpixel 112 are connected in the above manner, if the display panel is driven in the driving manner shown in FIGS. 2A-B or FIGS. 3A-B, the polarities of the driving signals in the first data line 210 and the second data line 220 may change according to the rule of +++++++ . . . or −−−−−−− . . . within a frame of time, that is, the polarities of the driving signals in the first data line 210 and the second data line 220 may not change within a frame of time, thereby reducing the frequency of the driving signals, reducing the heat generated in the circuit, further reducing the display power consumption of the display panel and avoiding overheating of the circuit. Of course, the polarities of the driving signals in the first data line 210 and the second data line 220 may be inverted during frame conversion to avoid polarization of the display panel and offset of the common voltage. Moreover, corresponding to the different driving modes shown in FIGS. 2A-B and 3A-B, the polarities of driving signals in the first data line and the second data line in adjacent display units are also different to meet the actual display requirements.

In this embodiment, the display panel includes a plurality of display units 100 extending along a first direction and arranged along a second direction; The display unit 100 includes a first subpixel column, a second subpixel column, a first data line 210, and a second data line 220 all of which are arranged along a second direction, the first subpixel column includes first subpixels 111 arranged along the first direction, and one first subpixel 111 is electrically connected only to one first data line 210 or one second data line 220;

the second subpixel column includes the second subpixels 112 arranged along the first direction, and one second subpixel 112 is electrically connected only to one first data line 210 or one second data line 220; the first data line 210 is electrically connected with the first subpixel 111 and the second subpixel 112 of a first driving polarity in the first subpixel column and the second subpixel column; the second data line 220 is electrically connected with the first subpixel 111 and the second subpixel 112 of the second driving polarity in the first subpixel column and the second subpixel column. During the operation of the display panel, the drive signal in the data line charges the first subpixel 111 and the second subpixel 112 to control the brightness of the first subpixel 111 and the second subpixel 112. When all the first subpixels 111 and the second subpixels 112 of the first driving polarity in a display unit are electrically connected with the first data line 210 and all the first and second subpixels 111 and 112 of the second driving polarity are electrically connected with the second data line 220, the first and second data lines 210 and 220 respectively output driving signals having the first and second driving polarities, at least for a period corresponding to a frame of the display screen. The first driving polarity and the second driving polarity are unchanged, so the polarity of the driving signal in the data line may remain unchanged. Compared with the case that the first subpixel and the second subpixel with different driving polarities are connected with the same data line, the frequency of the required driving signal is greatly reduced, thereby effectively reducing the driving power consumption of the display panel and the heat generated by the high-frequency driving signal, as well as avoiding potential danger caused by overheating of the circuit.

Further, as shown in FIG. 4, the first subpixel column, the first data line, the second data line and the second subpixel column are sequentially arranged along the second direction; in a first subpixel column, two first subpixels 111 adjacent to any first subpixel 111 are respectively electrically connected with the first data line 210 and the second data line 220; in a second subpixel column, two second subpixels 112 adjacent to any second subpixel 112 are respectively electrically connected with the first data line 210 and the second data line 220; the first subpixel 111 and the second subpixel 112 located on a same row in a display unit 100 are respectively electrically connected with the first data line 210 and the second data line 220.

Figure 5:
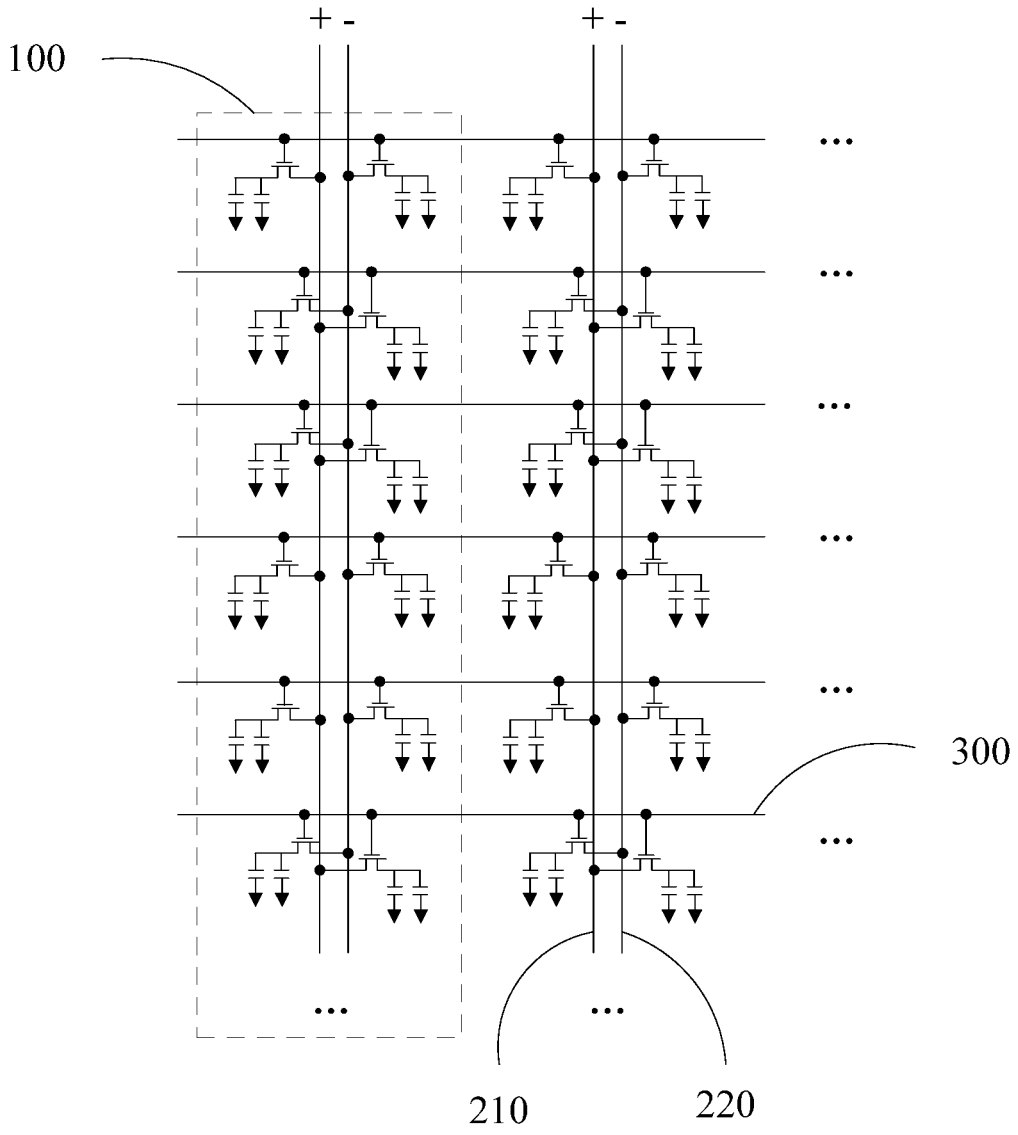
FIG. 5 is a schematic diagram of driving polarities of first data lines and second data lines corresponding to the driving mode in FIG. 2A.
Figure 6:
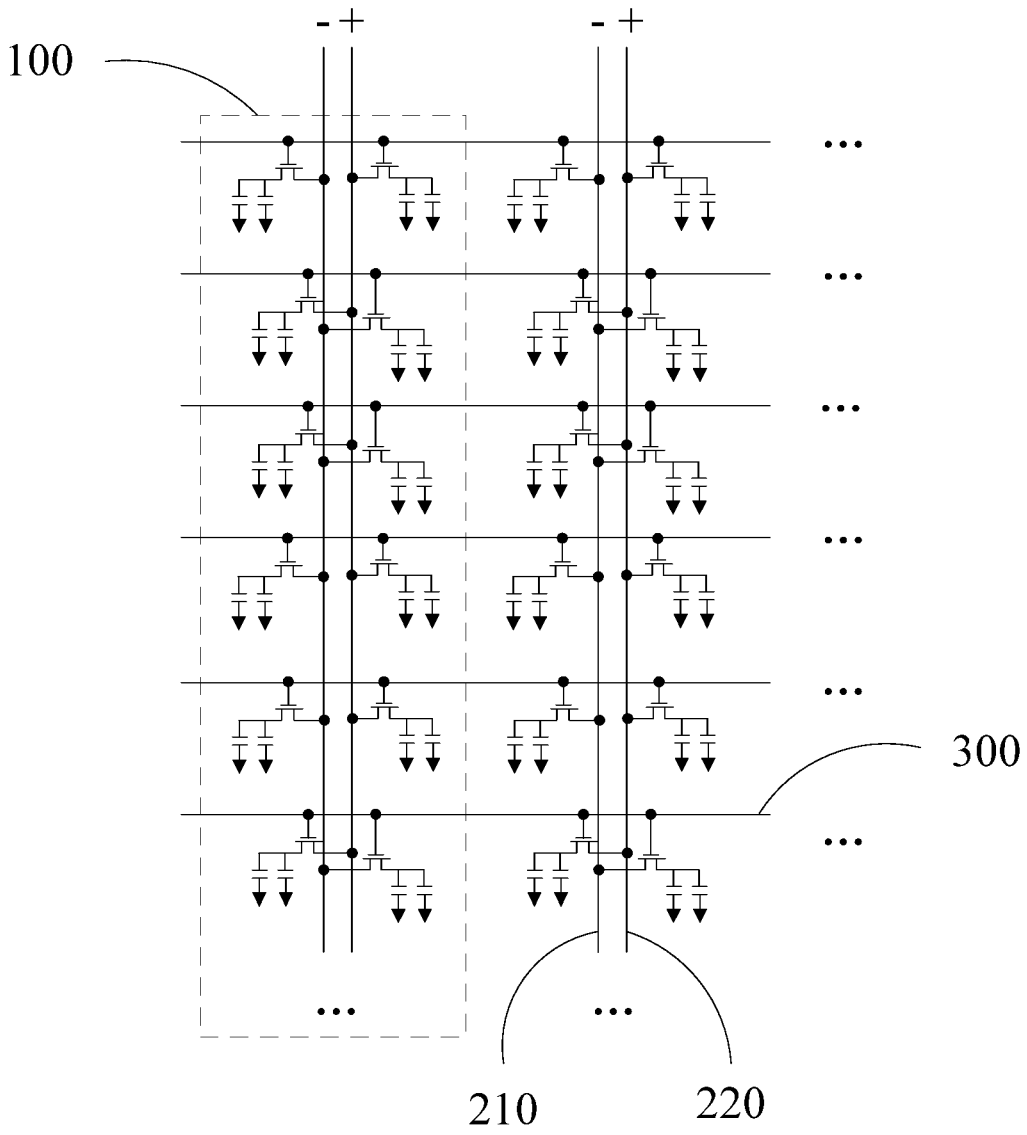
FIG. 6 is a schematic diagram of driving polarities of first data lines and second data lines corresponding to the driving mode in FIG. 2B.
Figure 7:
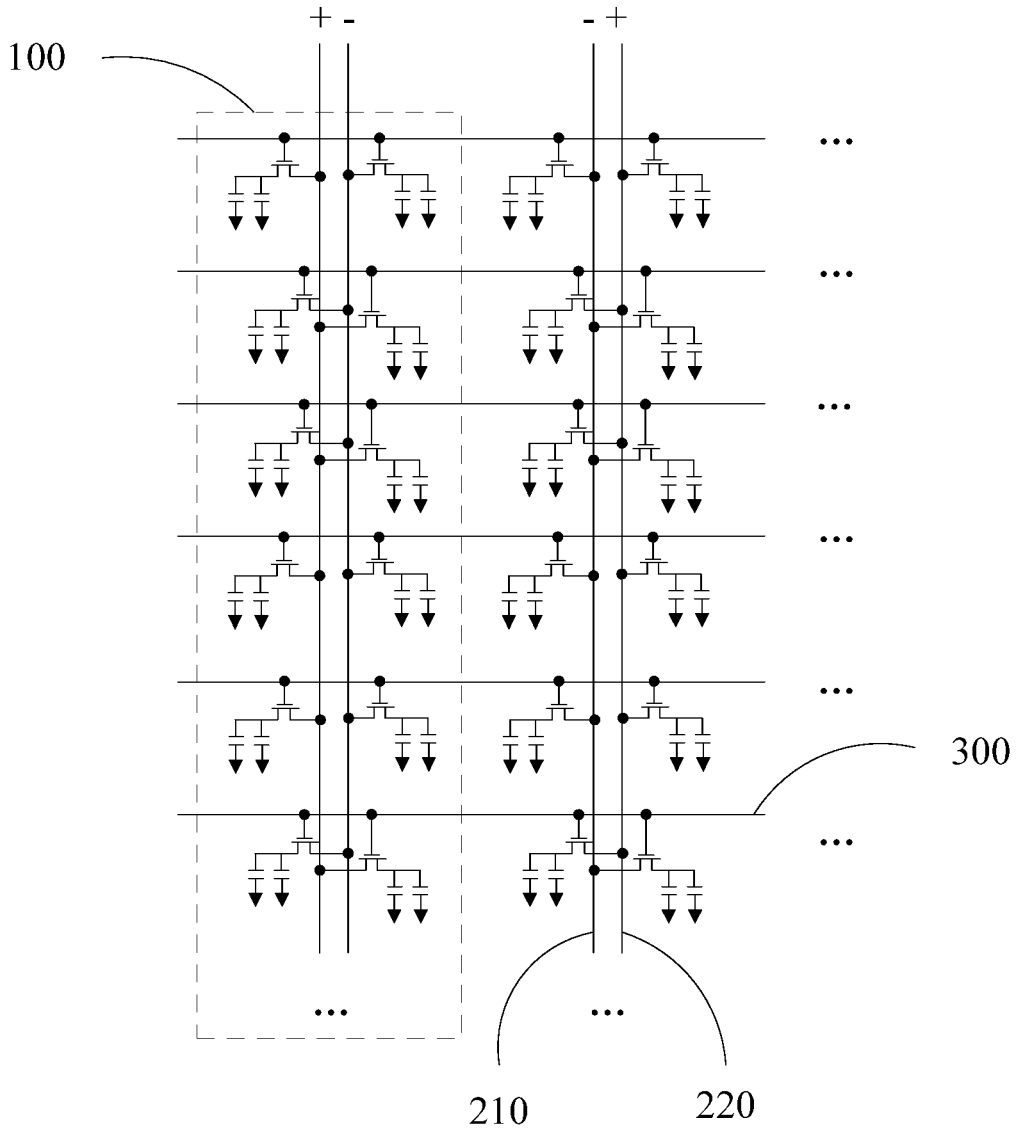
FIG. 7 is a schematic diagram of driving polarities of first data lines and second data lines corresponding to the driving mode in FIG. 3A.
Figure 8:
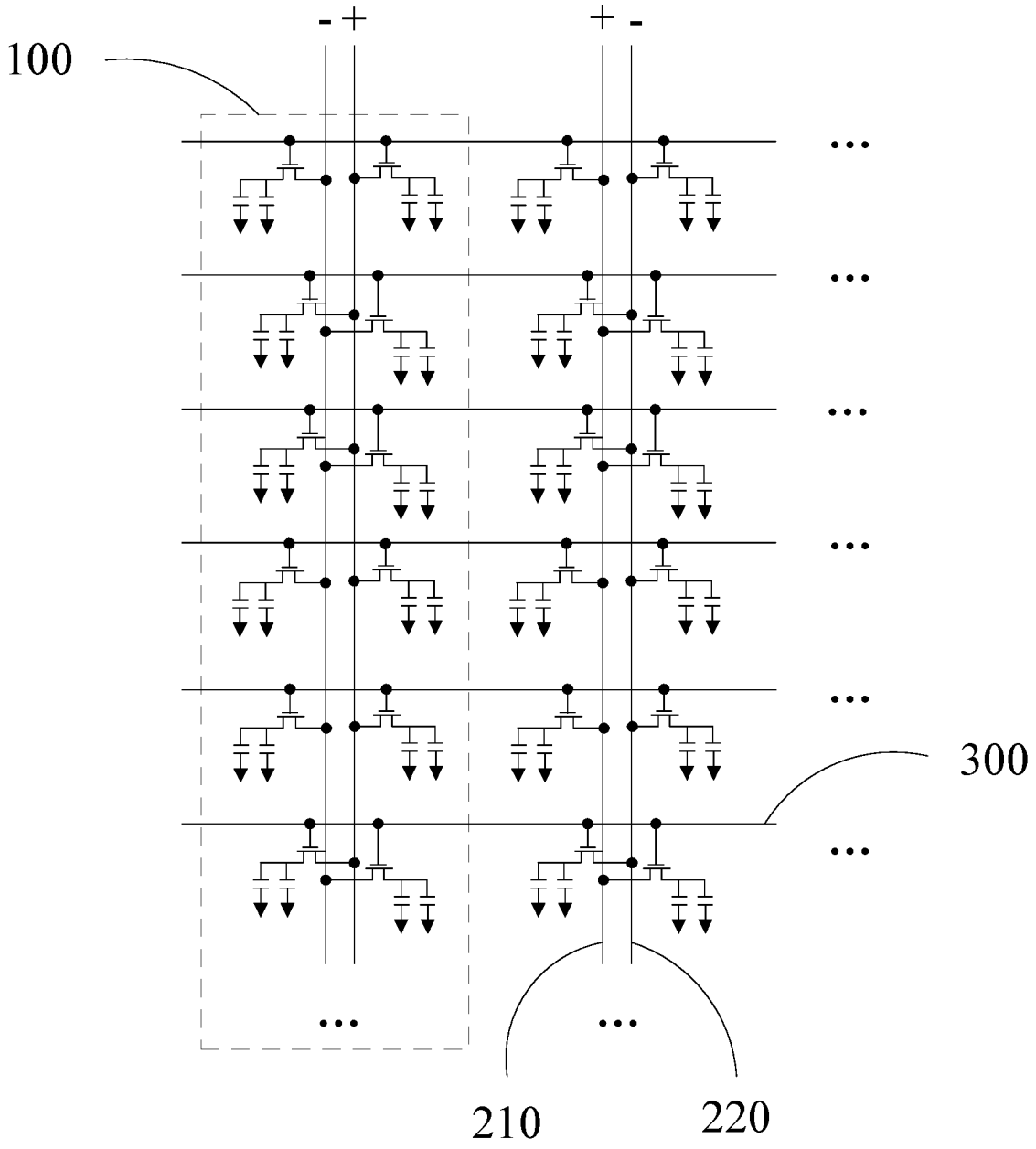
FIG. 8 is a schematic diagram of driving polarities of first data lines and second data lines corresponding to the driving mode in FIG. 3B.

In the display panel, the first subpixel 111 and the second subpixel 112 are arranged in a rectangular array to facilitate connection and reduce cross-lines on the display panel, thereby facilitating detection and maintenance of the display panel. When driving signals of the polarities shown in FIGS. 5 and 6 are input to adjacent display units 100, that is, when driving signals of adjacent second data line 220 and first data line 210 have opposite polarities in adjacent display units 100, the driving mode shown in FIGS. 2A and 2B may be realized. When driving signals of the polarities shown in FIGS. 7 and 8 are input to adjacent display units 100, that is, when driving signals of adjacent second data lines 220 and first data line 210 have the same polarities in adjacent display units 100, the driving mode shown in FIGS. 3A and 3B may be realized. In FIGS. 5 to 8, the driving signals of the first data line 210 and the second data line 220 in the same display unit 100 have opposite polarities. It should be noted that the same driving effect may also be achieved when the polarities of the driving signals in FIGS. 5 to 8 are all inverted, that is, when the positive electrode becomes the negative electrode and the negative electrode becomes the positive electrode. Based on the structure of the display panel shown in FIG. 4, various driving modes may be simultaneously realized without changing the structure of the display panel, so that the application range of the display panel is wider.

In the display panel, the driving polarities of the driving signals in the first data line 210 and the second data line 220 are periodically inverted, and the inversion period may be an integer multiple of the period corresponding to the frame rate of the display panel, so as to realize the inversion between frames, thereby avoiding polarization in the display panel, reducing the offset of the common voltage, and improving the display effect of the display panel.

Further, as shown in FIG. 4, the display panel also includes a plurality of scan lines 300, which extend along the second direction and are arranged along the first direction; the first subpixel 111 and the second subpixel 112 on a same row form a subpixel row, the subpixel row and the scanning line 300 are arranged alternately along the first direction, and the first subpixel 111 and the second subpixel 112 on a same row are electrically connected with the same scanning line 300, one first subpixel 111 is electrically connected with only one scanning line 300, and one second subpixel 112 is electrically connected with only one scanning line 300. The scanning line 300 controls each row of subpixels to be turned on row by row, and when the subpixels are turned on, the data line charges them to control the liquid crystal deflection so as to display a certain image.

Figure 9:
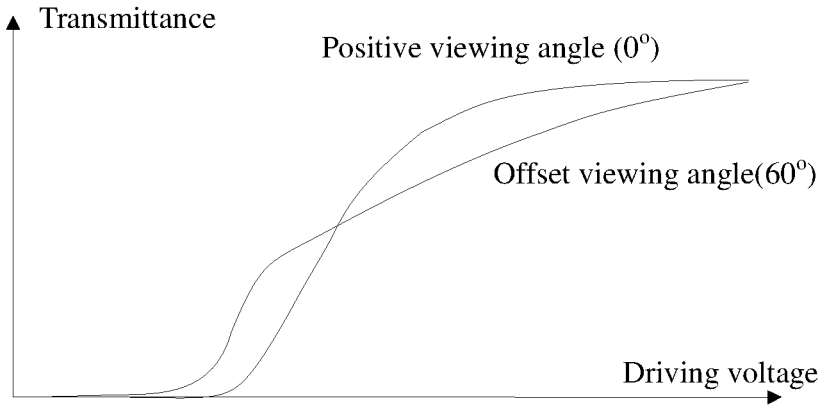
FIG. 9 is a schematic diagram of transmittance-driving voltage of a display panel in prior art at different viewing angles.
Figure 10:
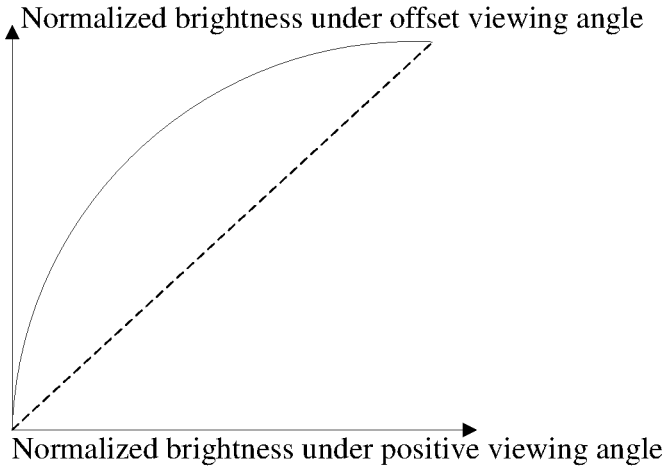
FIG. 10 is a schematic diagram of normalized brightness under offset viewing angle of a display panel in prior art—normalized brightness under positive viewing angle of the display panel in prior art.
Figure 11:
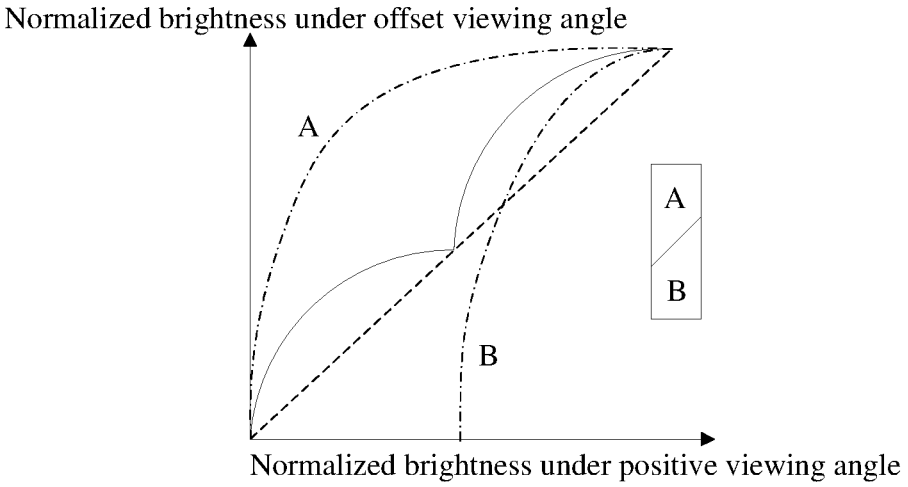
FIG. 11 is a schematic diagram of normalized brightness at offset viewing angle of another display panel in prior art—normalized brightness at positive viewing angle of another display panel in prior art.

Due to the limitation of liquid crystal deflection, as shown in FIG. 9, in prior art, the transmittance-driving voltage curve of the display panel under an offset viewing angle may drift relative to that under a positive viewing angle, resulting in a decrease of contrast of the picture and viewable angle, as well as generating color shift. As shown by the dashed lines in FIGS. 10 and 11, in an ideal case, the normalized brightness under the offset viewing angle is linearly related to the normalized brightness under the positive viewing angle, however, as shown by the solid lines in FIG. 10, in a practical case, the normalized brightness under the offset viewing angle is non-linearly related to the normalized brightness under the positive viewing angle, resulting in a smaller viewable angle of the display panel and a color shift. As shown in FIG. 11, also in prior art, in order to correct the phenomenon that the viewable angle of the display panel becomes smaller and the color is shifted, the pixel or subpixel is split into A part and B part, which are respectively controlled to display different brightness. In FIG. 11, the two solid lines correspond respectively to the relationships between the normalized brightness under the offset viewing angle and the positive viewing angle of part A and part B, where the brightness actually displayed by part A is higher and the brightness actually displayed by part B is lower, and the final effect of the mixing of part A and of part B are as shown by the solid line in FIG. 11, close to the ideal situation shown by the dashed line in FIG. 11, thereby improving the viewing angle of the display panel and reducing the color shift. However, this method of partitioning the pixels or subpixels themselves may be prone to result in a decrease in the transmittance of the pixels or subpixels in the display panel, making display quality of the display panel worse.

Figure 12:
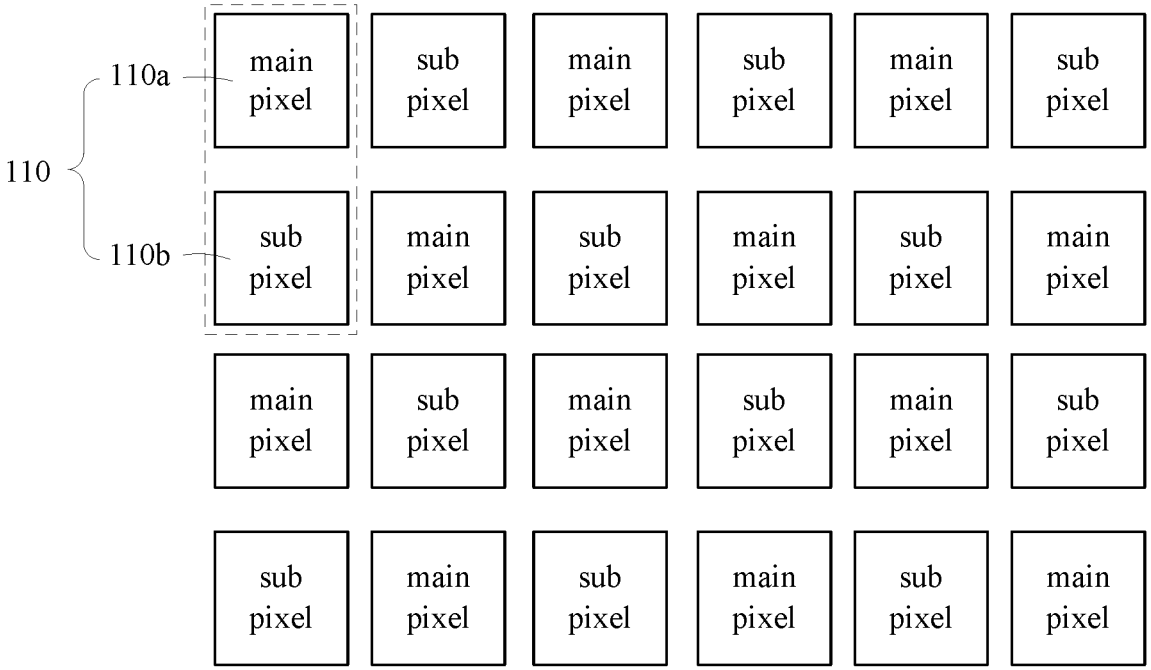
FIG. 12 is a schematic diagram of a pixel group structure of a display panel in some embodiments of the present disclosure.

In the present embodiment, in order to solve the above problems, as shown in FIG. 12, the display panel includes a plurality of pixel groups 110 including main pixels 110*a* and sub-pixels 110*b*, the main pixels 110*a* and the sub-pixels 110*b* are crosswise arranged, and the driving brightness of the main pixel 110*a* is greater than the original brightness of the main pixel 110*a*, and the driving brightness of the sub-pixel 110*b* is less than the original brightness of the sub-pixel 110*b*. The main pixel 110*a* and the sub-pixel 110*b* are formed by combining the first subpixel 111 and the second subpixel 112 according to a certain rule. By dividing the pixels in the pixel group 110 into the main pixels 110*a* and the sub-pixels 110*b*, and controlling the driving brightness of the main pixel 110*a* to be greater than its original brightness and the driving brightness of the sub-pixel 110*b* to be less than its original brightness, the relationships between the normalized brightness under the offset viewing angle and the positive viewing angle of part A and of part B as shown in FIG. 9 are simulated. Among them, the original brightness refers to the display brightness directly determined according to the original display screen, while the driving brightness is the brightness increased or decreased relative to the original brightness, thus increasing the viewable angle of the display panel, reducing color shift and improving the display effect of the display panel on the premise of ensuring the transmittance of the main pixels 110*a* and the sub-pixels 110*b* unchanged.

Figure 13:
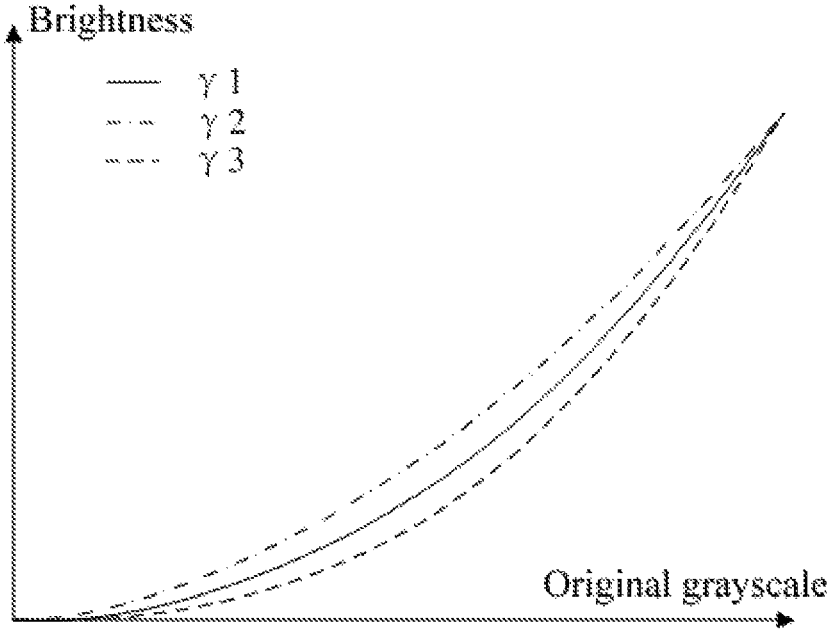
FIG. 13 is a schematic diagram of a gamma response of a display panel in some embodiments of the present disclosure.

Further, the mixed gamma response of the main pixels 110*a* and the sub-pixels 110*b* is equivalent to a preset gamma response. In the display panel, the part A and the part B shown in FIG. 11 are respectively simulated with the main pixel 110*a* and the sub-pixel 110*b*, increasing the viewable angle of the display panel and reducing the color shift. Specifically, the driving brightness of the main pixel 110*a* is larger than the original brightness of the main pixel 110*a*, and the driving brightness of the sub-pixel 110*b* is smaller than the original brightness of the sub-pixel 110*b*. The liquid crystal in the first subpixel 111 and the second subpixel 112 is deflected under the action of a driving signal in the data line, resulting in a change in light transmittance, thus showing different brightness. However, due to the influence of the photoelectric characteristics of the liquid crystal, if the driving signal is determined directly according to the initial picture signal, there may be a non-linear gamma response between the driving signal and the brightness of the final display. Therefore, in the driving process, it is necessary to perform inverse gamma correction on the initial picture signal to obtain the corrected driving signal to compensate for the non-linear characteristics of the display panel and realize distortion-free display. As shown in FIG. 13, when performing inverse gamma correction on the initial picture signal, the corrected gamma value in the inverse gamma correction process is determined according to the gamma value corresponding to the gamma response of the display panel, specifically, the relationship between the corrected gamma value and the gamma value is usually reciprocal. Gamma values reflect the characteristics of the display panel itself. Among them, the first gamma value corresponds to the normal display state, the typical first gamma value $\gamma 1$ is 2.2 to 2.5, and the commonly used first gamma value $\gamma 1$ is 2.2; The second gamma value $\gamma 2$ corresponds to a display state in which the display is bright, and the second gamma value $\gamma 2$ is smaller than the first gamma value $\gamma 1$; The third gamma value $\gamma 3$ corresponds to a display state in which the display is darker, and the third gamma value $\gamma 3$ corresponds to the first gamma value $\gamma 1$. Therefore, by selecting the appropriate second gamma value $\gamma 2$ and third gamma value $\gamma 3$, the mixed gamma response of the main pixels 110*a* and the sub-pixels 110*b* is made equivalent to the preset gamma response, i.e., the gamma response corresponding to the first gamma value $\gamma 1$, to improve the display effect.

Figure 14:
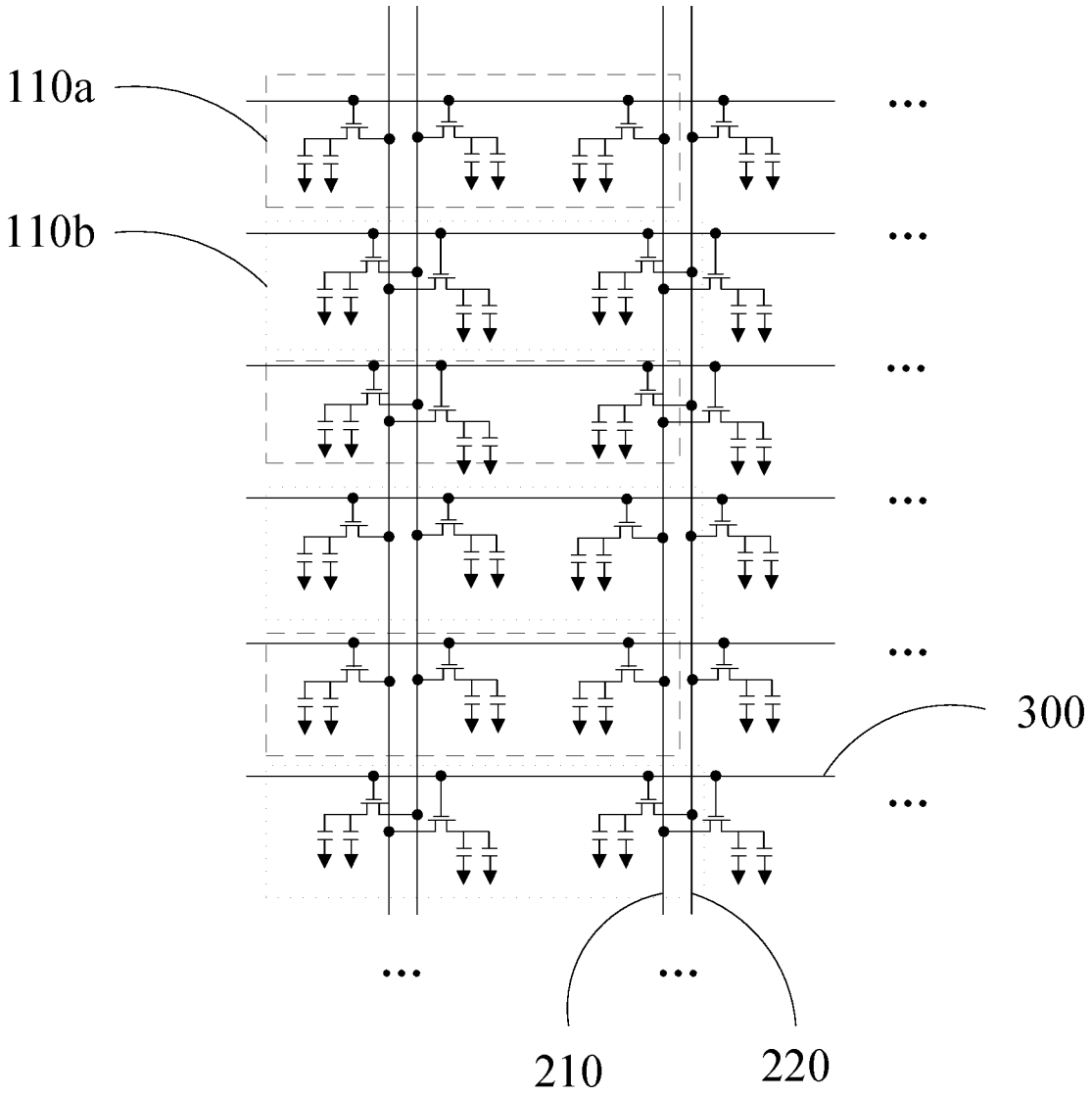
FIG. 14 is a schematic structural diagram of main pixels and sub-pixels of a display panel in some embodiments of the present disclosure.

Further, the main pixel 110*a* and the sub-pixel 110*b* themselves may adopt the same or similar structure. In some embodiments, as shown in FIG. 14, the main pixel 110*a* includes at least one first subpixel 111 and one second subpixel 112, which are adjacent to each other and continuously arranged along the second direction. The sub-pixel 110*b* includes at least one first subpixel 111 and one second subpixel 112, which are adjacent to each other and continuously arranged along the second direction. In general, the main pixel 110*a* includes three subpixels, namely, a red subpixel, a green subpixel and a blue subpixel. Similarly, the sub-pixel 110*b* includes three subpixels, namely, a red subordinate, a green subpixel and a blue subpixel, to realize the display of a color picture. The dashed line box in FIG. 14 shows the main pixel 110*a* and the dotted line box shows the sub-pixel 110*b*. Such frame helps to further reduce the frequency of driving signals in the first data line 210 and the second data line 220, thereby reducing circuit power consumption and thermal effect, while offering the first subpixel 111 and the second subpixel 112 sufficient charging time and improving the display effect of the display panel.

Figure 15:
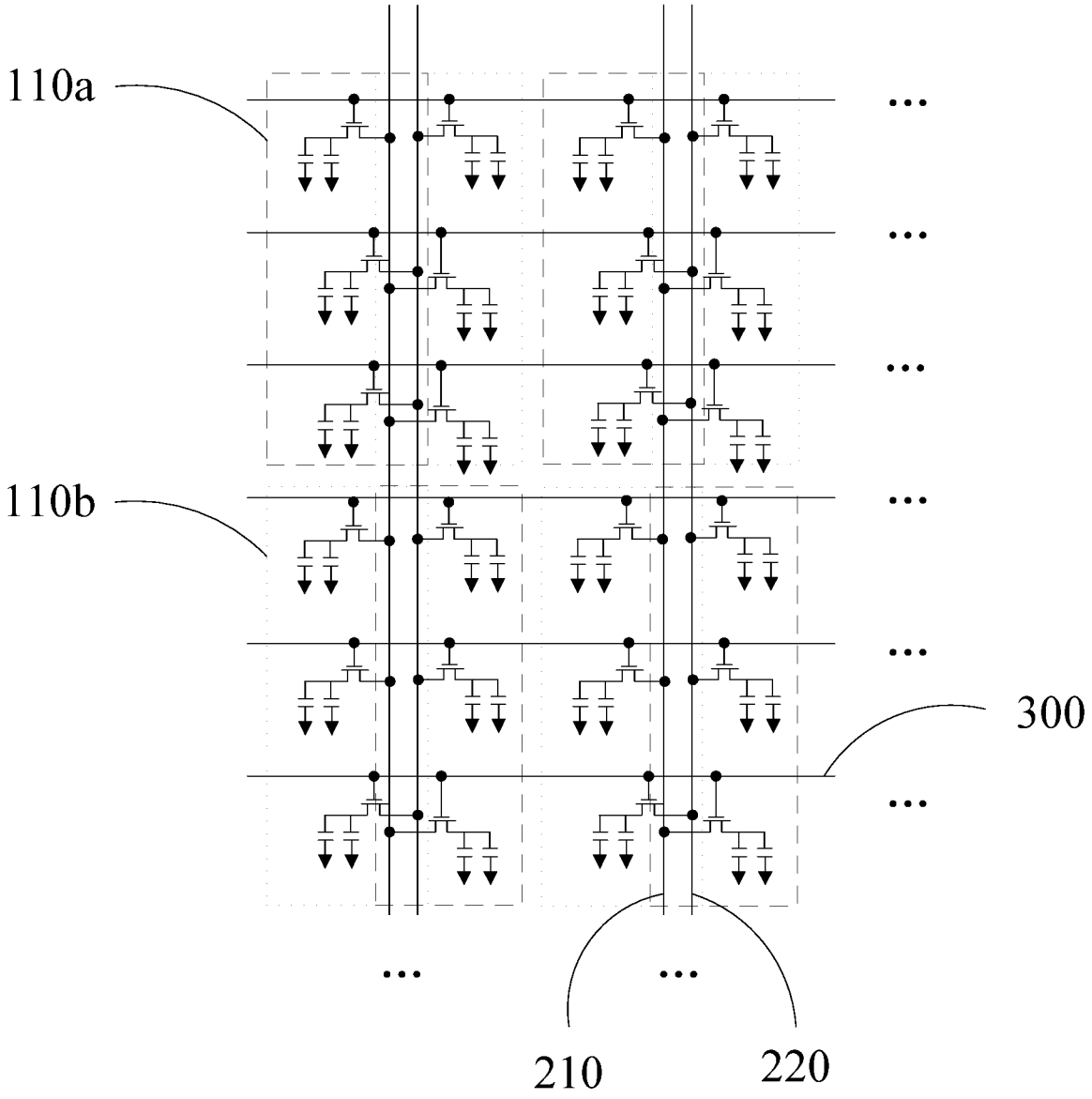
FIG. 15 is a schematic structural diagram of main pixels and sub-pixels of another display panel in some embodiments of the present disclosure.

In other embodiments, as shown in FIG. 15, the main pixel 110*a* includes at least one first subpixel 111 or one second subpixel 11, which are adjacent to each other and arranged along the first direction. The sub-pixel 110*b* includes at least one first subpixel 111 or a second subpixel 112, which are adjacent to each other and arranged along the first direction. The main pixel 110*a* is shown in the dashed line box in FIG. 15, and the sub-pixel 110*b* is shown in the dotted line box. This driving method helps to reduce the amount of the first data line 210 and the second data line 220 required in the display panel. Since the cost of the data line is higher than the cost of the scan line, the cost of the display panel may be reduced.

The present disclosure also proposes a display panel, as shown in FIG. 4, which includes a plurality of display units 100 and a plurality of scanning lines 300, and the display units 100 extend along a first direction and the display units 100 are arranged along a second direction; The display unit 100 includes a first subpixel column, a first data line 210, a second data line 220 and a second subpixel column which are sequentially arranged along a second direction, and the first subpixel column includes a first subpixel 111 arranged along the first direction, and in the first subpixel column, two first subpixels 111 adjacent to any first subpixel 111 are respectively electrically connected with the first data line 210 and the second data line 220; The second subpixel column includes second subpixels 112 arranged along the first direction, the second subpixels 112 and the first subpixels 111 are arranged in a rectangular array, and in the second subpixel column, two second subpixels 112 adjacent to any second subpixel 112 are respectively electrically connected with the first data line 210 and the second data line 220; The first subpixel 111 and the second subpixel 112 on a same row are respectively electrically connected with the first data line 210 and the second data line 220. The scanning lines 300 extend along the second direction and are arranged along the first direction. The first subpixel 111 and the second subpixel 112 on a same row form a subpixel row, the subpixel row and the scanning line 300 are arranged alternately along the first direction, and the first subpixel 111 and the second subpixel 112 on a same row are electrically connected with the same scanning line 300, one first subpixel 111 is electrically connected only to one scanning line 300, and one second subpixel 112 is electrically connected only to one scanning line 300. During the operation of the display panel, the drive signal in the data line charges the first subpixel 111 and the second subpixel 112 to control the brightness of the first subpixel 111 and the second subpixel 112. When connecting lines in the above-mentioned manner, the first driving polarity and the second driving polarity are unchanged at least for a duration corresponding to one frame of the display screen, so the polarity of the driving signal in the data line may remain unchanged. Compared with the case that the first subpixel and the second subpixel of different driving polarities are connected with the same data line, the frequency of the required driving signal is greatly reduced, thus effectively reducing the driving power consumption of the display panel and the heat generated by the high-frequency driving signal, and avoiding potential danger caused by overheating of the circuit. Moreover, two driving modes shown in FIGS. 2A-B and 3A-B may be realized based on the above-mentioned frame, thereby expanding the application range of the display panel.

The present disclosure also provides a display device, which includes a display panel and a driving unit, and the driving unit is electrically connected with the data line, and the driving unit is arranged to output a driving signal to the data line. The specific structure of the display panel is referred to the above embodiments and will not be described in detail here.

The above are only optional embodiments of the present disclosure and are not intended to limit the patent scope of the present disclosure. Any equivalent structural change made by using the contents of the specification and drawings of the present disclosure, or directly/indirectly applied in other related technical fields, is included in the patent scope of the present disclosure.

What is claimed is:

1. A display panel, wherein the display panel comprises a plurality of display units which extend along a first direction and are arranged along a second direction;

the display unit comprises a first subpixel column, a second subpixel column, a first data line, and a second data line, all of which are arranged along the second direction, and the first subpixel column comprises first subpixels arranged along the first direction, and one first subpixel is electrically connected only with the first data line or the second data line;

the second subpixel column comprises second subpixels arranged along the first direction, and one second subpixel is only electrically connected with the first data line or the second data line;

the first data line is electrically connected with the first subpixel and the second subpixel of a first driving polarity in the first subpixel column and the second subpixel column; and, the second data line is electrically connected with the first subpixel and the second subpixel of a second driving polarity in the first subpixel column and the second subpixel column.

2. The display panel according to claim 1, wherein the first subpixel column, the first data line, the second data line, and the second subpixel column are sequentially arranged along the second direction;

in one first subpixel column, two first subpixels adjacent to any first subpixel are respectively electrically connected with the first data line and the second data line;

in one second subpixel column, two second subpixels adjacent to any second subpixel are respectively electrically connected with the first data line and the second data line; and, the first subpixel and the second subpixel located on a same row in one display unit are respectively electrically connected with the first data line and the second data line.

3. The display panel of claim 1, wherein the display panel further comprises:

a plurality of scan lines, extending along the second direction and arranged along the first direction; and, the first subpixel and the second subpixel on a same row form a subpixel row, the subpixel row and the scanning line are arranged alternately along a first direction, and the first subpixel and the second subpixel in the same row are electrically connected with the same scanning line, one first subpixel is electrically connected with only one scanning line, and one second subpixel is electrically connected with only one scanning line.

4. The display panel according to claim 1, wherein the display panel comprises a plurality of pixel groups, the pixel group comprises a main pixel and a sub-pixel, the main pixel and the sub-pixel are arranged crosswise, and the driving brightness of the main pixel is greater than the original brightness of the main pixel, and the driving brightness of the sub-pixel is less than the original brightness of the sub-pixel.

5. The display panel of claim 4, wherein the mixed gamma response of the main pixel and the sub-pixel is equivalent to a preset gamma response.

6. The display panel according to claim 4, wherein the main pixel comprises at least one first subpixel and one second subpixel which are adjacent to each other and arranged continuously along the second direction; the sub-pixel comprises at least one first subpixel and one second subpixel which are adjacent to each other and arranged continuously along the second direction.

7. The display panel according to claim 4, wherein the main pixel comprises at least one first subpixel or one second subpixel which are adjacent to each other and arranged continuously along the first direction; the sub-pixel comprises at least one first subpixel or one second subpixel which are adjacent to each other and arranged continuously along the first direction.

8. The display panel of claim 4, wherein the display panel further comprises:

a plurality of scan lines, extending along the second direction and arranged along the first direction; and, the first subpixel and the second subpixel on a same row form a subpixel row, the subpixel row and the scanning line are alternately arranged along the first direction, and the first subpixel and the second subpixel on a same row are electrically connected with the same scanning line, one first subpixel is electrically connected with only one scanning line, and one second subpixel is electrically connected with only one scanning line.

9. The display panel according to claim 1, wherein driving polarity of a driving signal in the data line is periodically inverted.

10. A display panel, wherein the display panel comprises:

a plurality of display units, extending along a first direction and arranged along a second direction; the display unit comprises a first subpixel column, a first data line, a second data line and a second subpixel column which are sequentially arranged along the second direction, wherein the first subpixel column comprises first subpixels arranged along the first direction, and two first subpixels adjacent to any first subpixel in the first subpixel column are respectively electrically connected with the first data line and the second data line; the second subpixel column comprises second subpixels arranged along the first direction, the second subpixels and the first subpixels are arranged in a rectangular array, and two second subpixels adjacent to any second subpixel in the second subpixel column are respectively electrically connected with the first data line and the second data line; the first subpixel and the second subpixel located on a same row are respectively electrically connected with the first data line and the second data line; and, a plurality of scanning lines, extending along the second direction, and the scanning lines are arranged along the first direction, the first subpixel and the second subpixel on a same row form a subpixel row, the subpixel row and the scanning line are arranged alternately along the first direction, and the first subpixel and the second subpixel on a same row are electrically connected with the same scanning line, one first subpixel is electrically connected with only one scanning line, and one second subpixel is electrically connected with only one scanning line.

11. A display device, wherein the display device comprises:

a display panel, comprising a plurality of display units extending along a first direction and arranged along a second direction; the display unit comprises a first subpixel column, a second subpixel column, a first data line and a second data line, all of which arranged along a second direction, wherein the first subpixel column comprises first subpixels arranged along the first direction, and one first subpixel is electrically connected with only one of the first data line or the second data line; the second subpixel column comprises second subpixels arranged along the first direction, and one second subpixel is only electrically connected with one first data line or one second data line; the first data line is electrically connected with the first subpixel and the second subpixel of a first driving polarity in the first subpixel column and the second subpixel column; the second data line is electrically connected with the first subpixel and the second subpixel of a second driving polarity in the first subpixel column and the second subpixel column; and, a driving unit, electrically connected with the data line, and the driving unit being configured to output a driving signal to the data line.

12. The display device according to claim 11, wherein the first subpixel column, the first data line, the second data line and the second subpixel column are sequentially arranged along the second direction;

in one first subpixel column, two first subpixels adjacent to any first subpixel are respectively electrically connected with the first data line and the second data line;

in one second subpixel column, two second subpixels adjacent to any second subpixel are respectively electrically connected with the first data line and the second data line;

the first subpixel and the second subpixel located on a same row in one display unit are respectively electrically connected with the first data line and the second data line.

13. The display device of claim 11, wherein the display panel further comprises:

a plurality of scan lines, extending along the second direction and arranged along the first direction;

the first subpixel and the second subpixel on a same row form a subpixel row, the subpixel row and the scanning line are alternately arranged along the first direction, and the first subpixel and the second subpixel on a same row are electrically connected with the same scanning line, one first subpixel is electrically connected with only one scanning line, and one second subpixel is electrically connected with only one scanning line.

14. The display device according to claim 11, wherein the display panel comprises a plurality of pixel groups, the pixel group comprises a main pixel and a sub-pixel, the main pixel and the sub-pixel are crosswise arranged, and the driving brightness of the main pixel is greater than the original brightness of the main pixel, and the driving brightness of the sub-pixel is less than the original brightness of the sub-pixel.

15. The display device of claim 14, wherein the mixed gamma response of the main pixel and the sub-pixel is equivalent to a preset gamma response.

16. The display device according to claim 14, wherein the main pixel comprises at least one first subpixel and one second subpixel which are adjacent to each other and continuously arranged along the second direction; the sub-pixel comprises at least one first subpixel and one second subpixel which are adjacent to each other and continuously arranged along the second direction.

17. The display device according to claim 14, wherein the main pixel comprises at least one first subpixel or one second subpixel which are adjacent to each other and continuously arranged along the first direction; the sub-pixel comprises at least one first subpixel or one second subpixel which are adjacent to each other and continuously arranged along the first direction.

18. The display panel of claim 14, wherein the display panel further comprises:

a plurality of scan lines, extending along the second direction and arranged along the first direction; and, the first subpixel and the second subpixel on a same row form a subpixel row, the subpixel row and the scanning line are arranged alternately along the first direction, and the first subpixel and the second subpixel on a same row are electrically connected with the same scanning line, one first subpixel is electrically connected with only one scanning line, and one second subpixel is electrically connected with only one scanning line.

19. The display device according to claim 11, wherein driving polarity of a driving signal in the data line is periodically inverted.

20. The display device according to claim 11, wherein in the first subpixel column, two first subpixels adjacent to any first subpixel are respectively electrically connected with the first data line and the second data line; the second subpixel and the first subpixel are arranged in a rectangular array, and in the second subpixel column, two second subpixels adjacent to any second subpixel are respectively electrically connected with the first data line and the second data line; the first subpixel and the second subpixel located on a same row are respectively electrically connected with the first data line and the second data line; and, the display panel comprises a plurality of scan lines extending along the second direction, and the scan lines are arranged along the first direction, the first subpixel and the second subpixel on a same row form a subpixel row, the subpixel row and the scan line are arranged alternately along the first direction, and the first subpixel and the second subpixel on a same row are electrically connected with the same scan line, one first subpixel is electrically connected with only one scan line, and one second subpixel is electrically connected with only one scan line.

* * * * *